US006663464B2

(12) United States Patent
Payne et al.

(10) Patent No.: US 6,663,464 B2
(45) Date of Patent: Dec. 16, 2003

(54) TOY CAR WASH PLAY SET

(75) Inventors: Julian R. Payne, Delran, NJ (US); Trevor J. Hayes, Medford, NJ (US); Robert A. Butkiewicz, Shamong, NJ (US); Jeremy S. Robotham, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/271,886

(22) Filed: Oct. 16, 2002

(65) Prior Publication Data

US 2003/0082985 A1 May 1, 2003

Related U.S. Application Data

(60) Provisional application No. 60/339,799, filed on Oct. 31, 2001.

(51) Int. Cl.[7] ..... A63H 17/44

(52) U.S. Cl. ..... 446/423; 446/15; 446/16

(58) Field of Search ..... 446/15–21, 236, 446/423, 484, 476, 267

(56) References Cited

U.S. PATENT DOCUMENTS

| | | | | |
|---|---|---|---|---|
| 2,452,794 | A | * 11/1948 | Saachy | |
| 3,100,947 | A | * 8/1963 | Hellman | |
| 3,593,454 | A | 7/1971 | Einfalt | |
| 4,091,561 | A | 5/1978 | Kimura | |
| 4,356,657 | A | 11/1982 | Goldfarb et al. | |
| 4,423,565 | A | 1/1984 | Bart | |
| 4,775,348 | A | 10/1988 | Collins | |
| 5,015,210 | A | 5/1991 | Dideriksen | |
| 5,395,274 | A | 3/1995 | Myers | |
| 5,441,435 | A | 8/1995 | Shiraishi | |
| 5,586,923 | A | 12/1996 | Hippely et al. | |
| 5,871,385 | A | 2/1999 | Hippely et al. | |
| 5,899,789 | A | 5/1999 | Rehkemper et al. | |
| 5,908,057 | A | 6/1999 | Schramm | |
| 6,050,872 | A | * 4/2000 | Cahill et al. | 446/89 |
| 6,149,486 | A | 11/2000 | Thai | |
| 6,200,184 | B1 | 3/2001 | Rich et al. | |
| 6,223,757 | B1 | * 5/2001 | Horvath et al. | 134/123 |
| 6,250,768 | B1 | 6/2001 | Hill | |

FOREIGN PATENT DOCUMENTS

| | | |
|---|---|---|
| GB | 2 165 022 A | 4/1986 |

* cited by examiner

*Primary Examiner*—Jacob K. Ackun
*Assistant Examiner*—Jamila O Williams
(74) *Attorney, Agent, or Firm*—Akin, Gump, Strauss, Hauer & Feld, L.L.P.

(57) ABSTRACT

A toy car wash play set including a toy vehicle car wash station, including a conveyer belt for transporting a toy vehicle from a first position to a second position, scrubbing rollers for simulating scrubbing rollers used in car washes for full-scale vehicles, and a bubble producing apparatus for simulating soap suds generated by car washes for full-scale vehicles. The conveyer belt and the bubble producing apparatus are motorized. The toy car wash play set further comprises a base section, the car wash station being elevated with respect to the base section. A manually operated elevator for raising a toy vehicle from the base section to the car wash station is provided, along with a rinse station which may be rotated under the action of a manual actuator. The toy car wash may further comprise a drying station which includes a fan which may be rotated under the action of a manual actuator and a rotating table in the base section rotatable under the action of a manual actuator.

15 Claims, 14 Drawing Sheets

TOY CAR WASH PLAY SET

CROSS-REFERENCE TO RELATED APPLICATIONS

This application claims benefit of U.S. Provisional Patent Application No. 60/339,799, "Toy Car Wash Play Set", filed Oct. 31, 2001, the subject matter of which is incorporated herein by reference.

BACKGROUND OF THE INVENTION

The invention relates to toy play sets for use with conventional, unpowered, 1/64 scale toy vehicles (e.g., Hot Wheels® and Matchbox® toy vehicles) to enhance the play value of such vehicles.

BRIEF SUMMARY OF THE INVENTION

According to a first preferred embodiment of the invention, a toy car wash play set comprising a toy vehicle car wash station, including a conveyer belt for transporting a toy vehicle from a first position to a second position, scrubbing rollers for simulating scrubbing rollers used in car washes for full-scale vehicles, and a bubble producing apparatus for simulating soap suds generated by car washes for full-scale vehicles is disclosed. The conveyer belt and the bubble producing apparatus are motorized. The toy car wash play set further comprises a base section, the car wash station being elevated with respect to the base section by structural members connecting the base section to the car wash station. A manually operated elevator for raising a toy vehicle from the base section to the car wash station is provided, along with a rinse station which may be rotated under the action of a manual actuator. The toy car wash may further comprise a drying station which includes a fan which may be rotated under the action of a manual actuator and a rotating table in the base section rotatable under the action of a manual actuator. The motorized bubble producing apparatus further comprises a rotating wheel driven by an electric motor, wherein the rotating wheel has at least one aperture through the rotating wheel, and wherein the rotating wheel is partially immersed in a reservoir of bubble-producing solution, so that the aperture is covered by the bubble-producing solution as the rotating wheel rotates through the bubble-producing solution in the reservoir. The bubble producing apparatus further comprising a fan driven by the electric motor, wherein the fan blows air through the bubble-producing solution covered aperture, thus producing bubbles.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
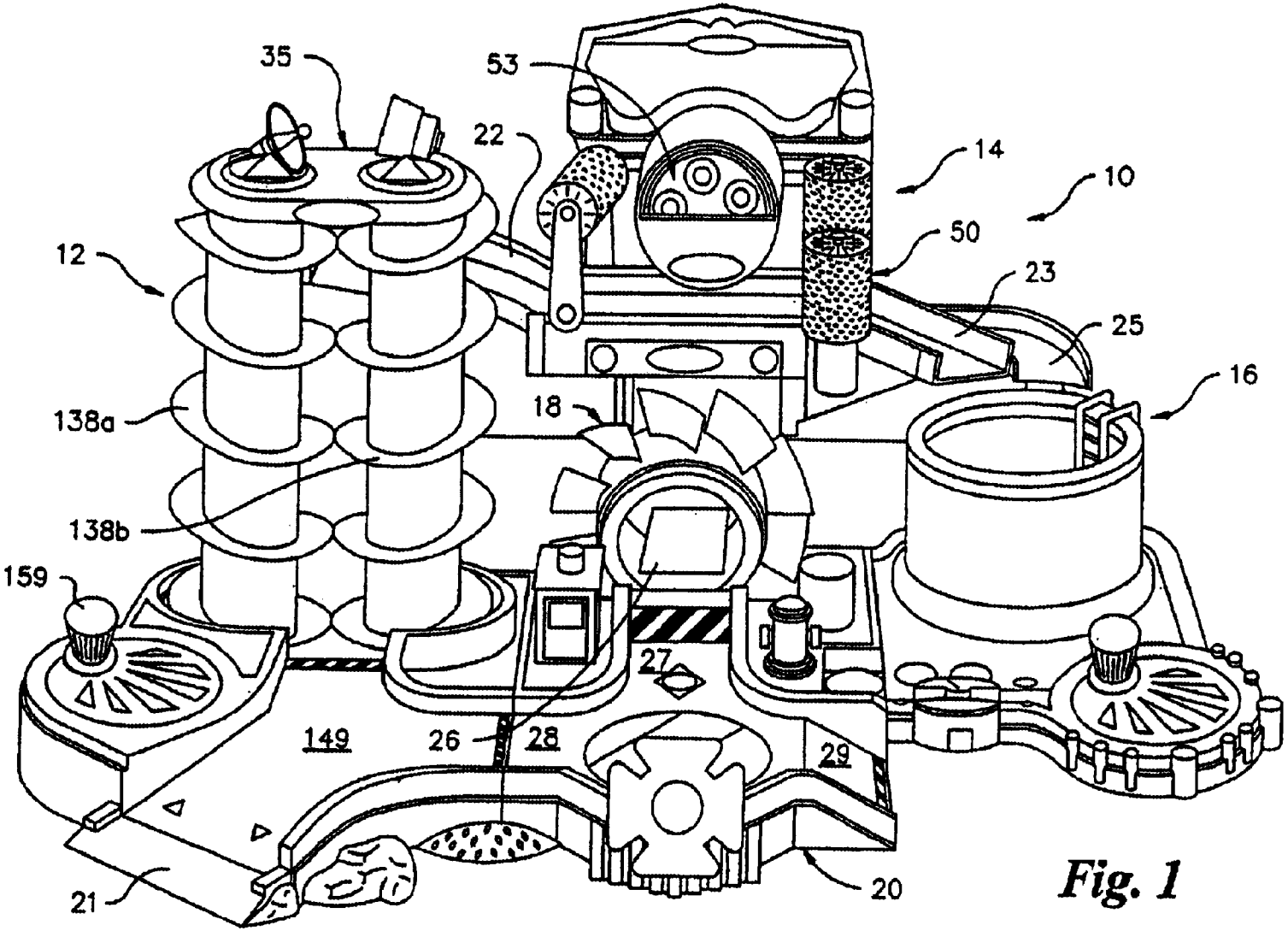
FIG. 1 is a front perspective view of a first embodiment of a toy car wash play set in accordance with the present invention.
Figure 2:
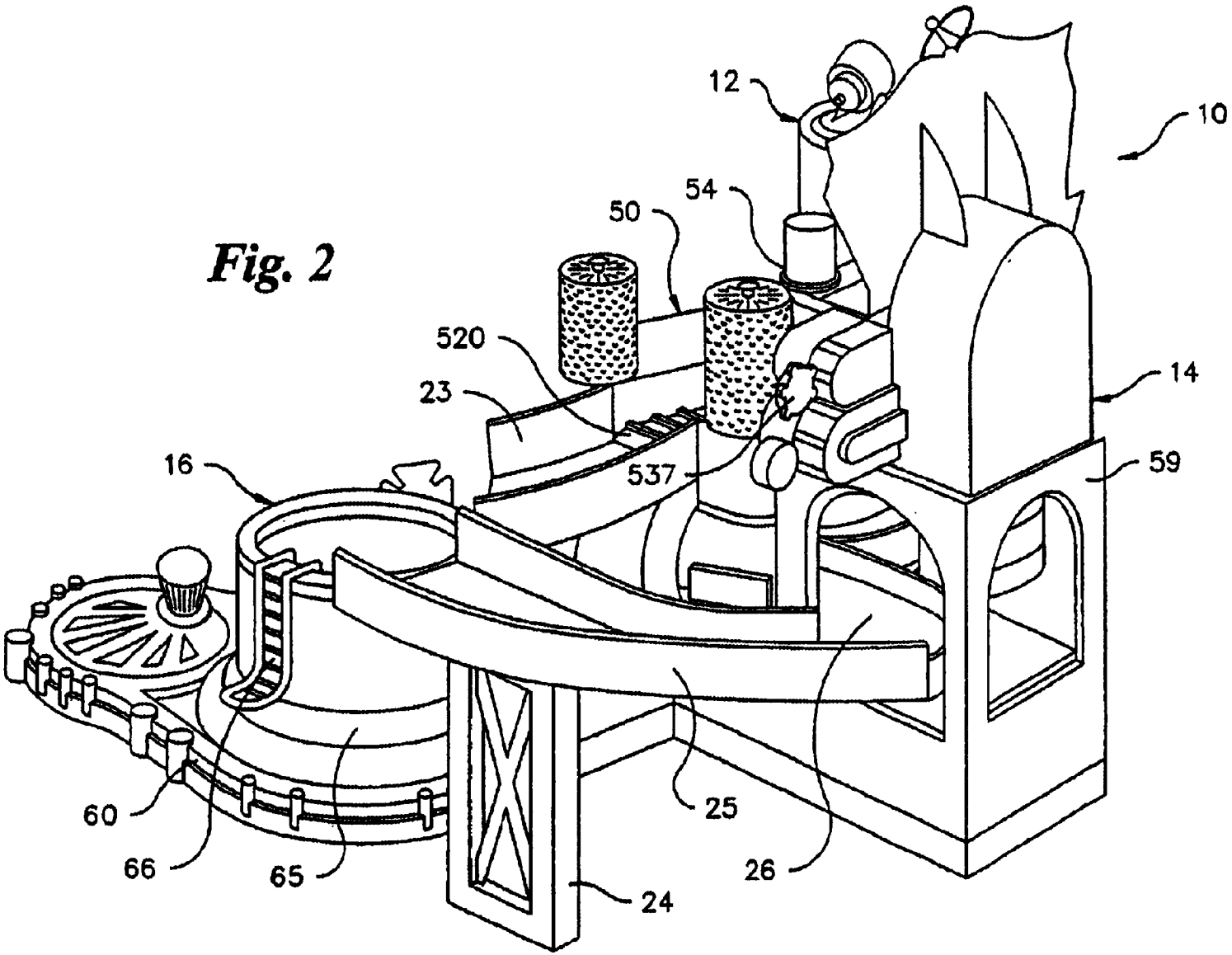
FIG. 2 is a left rear perspective view of the play set of FIG. 1.
Figure 3:
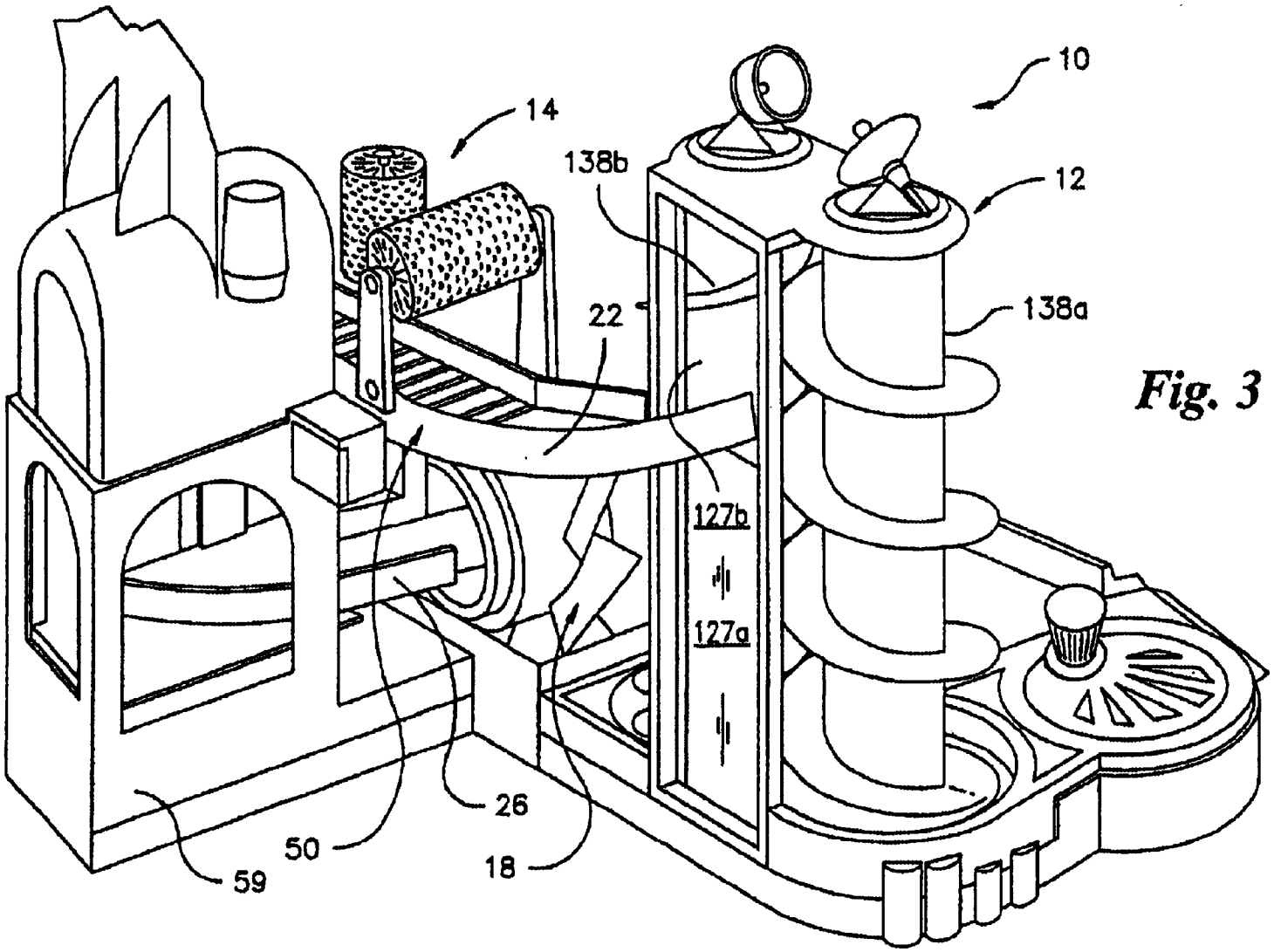
FIG. 3 is a right rear perspective view of the play set of FIG. 1.

Shown in FIGS. 1–3 is a first embodiment, assembled, toy car wash play set in accordance with a preferred embodiment of the present invention indicated generally at 10. The major components of the play set include an elevator 12 with entrance ramp 21 leading to an elevated car wash/conveyer/bubble maker indicated generally at 14 leading to a car rinse station indicated generally at 16. Ramp section 22 connects the exit of the elevator 12 with the entrance of the car wash conveyer/bubble maker 14. Ramp section 23 connects the exit of the conveyer with the car rinse station 16. The car rinse station 16 is connected by yet another ramp section 25 to yet another ramp section 26, which extends through an elevated base 59 supporting the car wash conveyer/bubble maker 14 and to a "dryer" station indicated generally at 18. The ramp section 25 is supported by a pier 24. The discharge end of ramp section 26 connects to a central ramp 27 of a discharge station indicated generally at 20 which has a ramp 28 leading to the elevator 12 and an opposing exit ramp 29.

Figure 4:
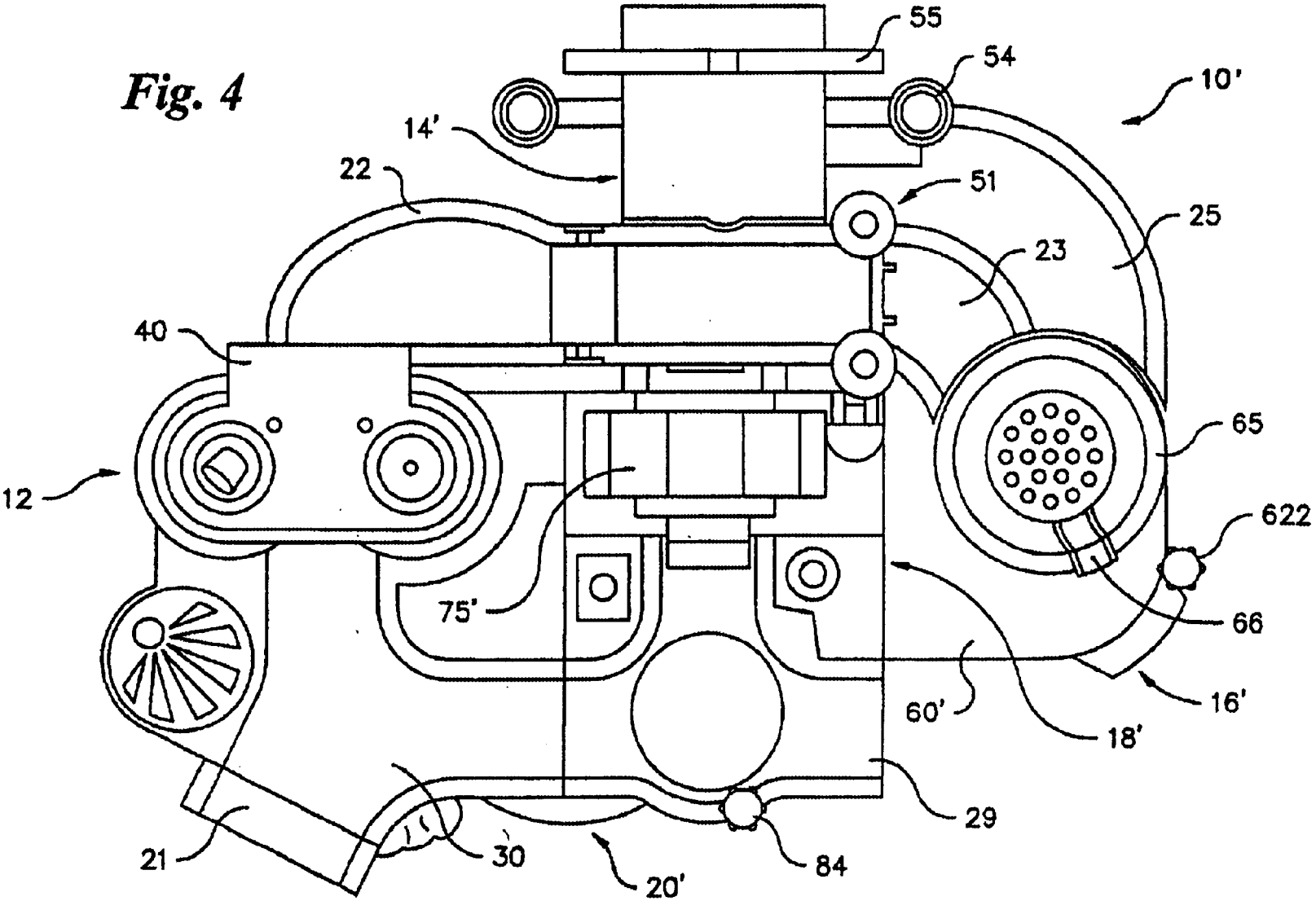
FIG. 4 is a top plan view of a second embodiment of a toy car wash play set in accordance with the present invention, the second embodiment being a second generation play set derived from the play set of FIG. 1.
Figure 5:
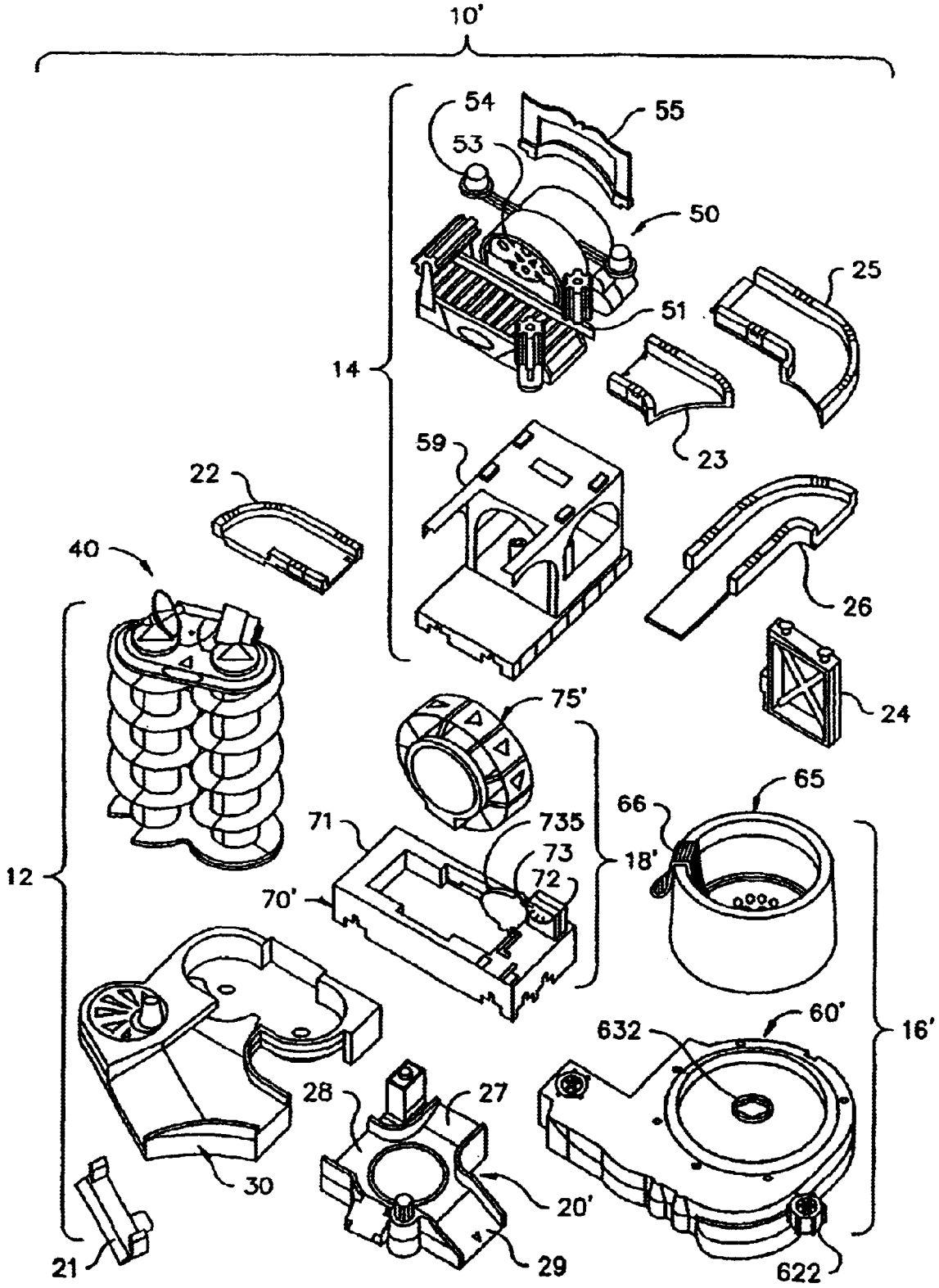
FIG. 5 is an exploded perspective view of the major assemblies and connective components of the play set of FIG. 4.

FIGS. 4 and 5 illustrate a second generation play set indicated generally at 10' derived from the play set 10 of FIGS. 1 through 3 with many components identical. Play set 10' components include an elevator base assembly indicated generally at 30 supporting and operatively coupled to an elevator assembly indicated generally at 40, which together form the elevator 12. A conveyer/bubble maker assembly indicated generally at 50 with base indicated generally at 59 form the elevated car wash/conveyer bubble maker 14. A slightly modified rinse station 16' includes a modified rinse unit base indicated generally at 60' with rinse tub 65 with ladle 66. A modified dryer station 18' is formed by a modified base indicated generally at 70' with a modified fan assembly 75'. A modified discharge station is indicated generally at 20'. Also shown are the same ramp sections and supports 21–29.

Figure 6:
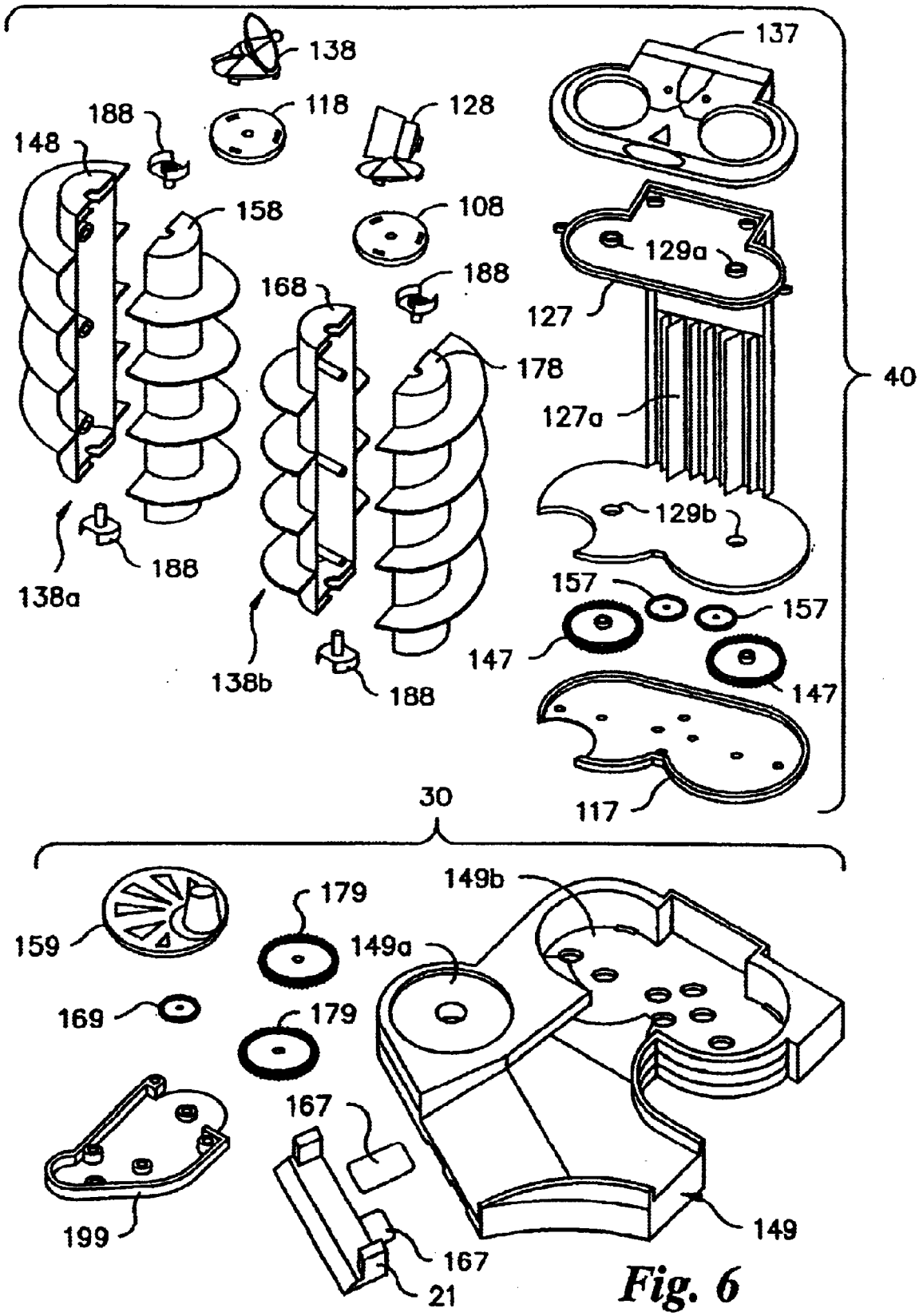
FIG. 6 is an exploded perspective view of the components of a twin spiral elevator unit of FIG. 4.

Turning now to FIG. 6, the elevator base assembly 30 and elevator assembly 40 are each shown in exploded view.

Elevator base assembly 30 includes an entrance ramp 21 coupled to the base member 149 by suitable means such as plug in connectors 168. Base member 149 includes a first recess 149*a* receiving a crank 159. The crank 159 is rotatably coupled to a gear 169 which engages with two other spur gears 179 beneath the base unit 149 by a bottom cover 199.

The elevator 40 includes a spiral base plate 117 received in a recess 149*b* of the main base member 149, a support 127, the bottom of which is also received in recess 149*b*, and a roof 137 mounted to the top of the support 127. Supported for rotation between the base plate 117 and the bottom of support 127 are drive gears 147 and idler gears 157. The support 127 includes a pair of top and bottom journals 128, 129, respectively, which are configured to receive each of a pair of complementary spirals or screws 138*a*, 138*b*, one left-hand wound and the other right hand wound. Spiral 138*a* is formed by half shells 148, 158 keyed with a pair of identical spiral mount members 188 at the top and bottom. The second spiral 138*b* is formed by half spirals 168, 178 keyed with a pair of the mounts 188 at the top and bottom. The bottom mounts 188 are keyed to engage gears 147 and the spirals 138*a*, 138*b* so that the spirals 138*a*, 138*b* rotate in opposite directions. The right spiral 138*b* is rotatably coupled through upper mount 188 to a cover plate 108, which supports a simulated spotlight 128 for rotation on the roof 137. Spiral 138*a* is similarly coupled through cover plate 118 to a simulated radar antenna 138 for rotation on the roof 137. Spotlight 128 and radar antenna 138 rotate with the spirals 138*a*, 138*b*, which are driven to rotate in opposite directions by crank 159 and one of the idler spur gears 179 engaging the left drive gear 147 in base 149. Right gear 147 is coupled to left gear 147 through idler gears 157.

Figure 7:
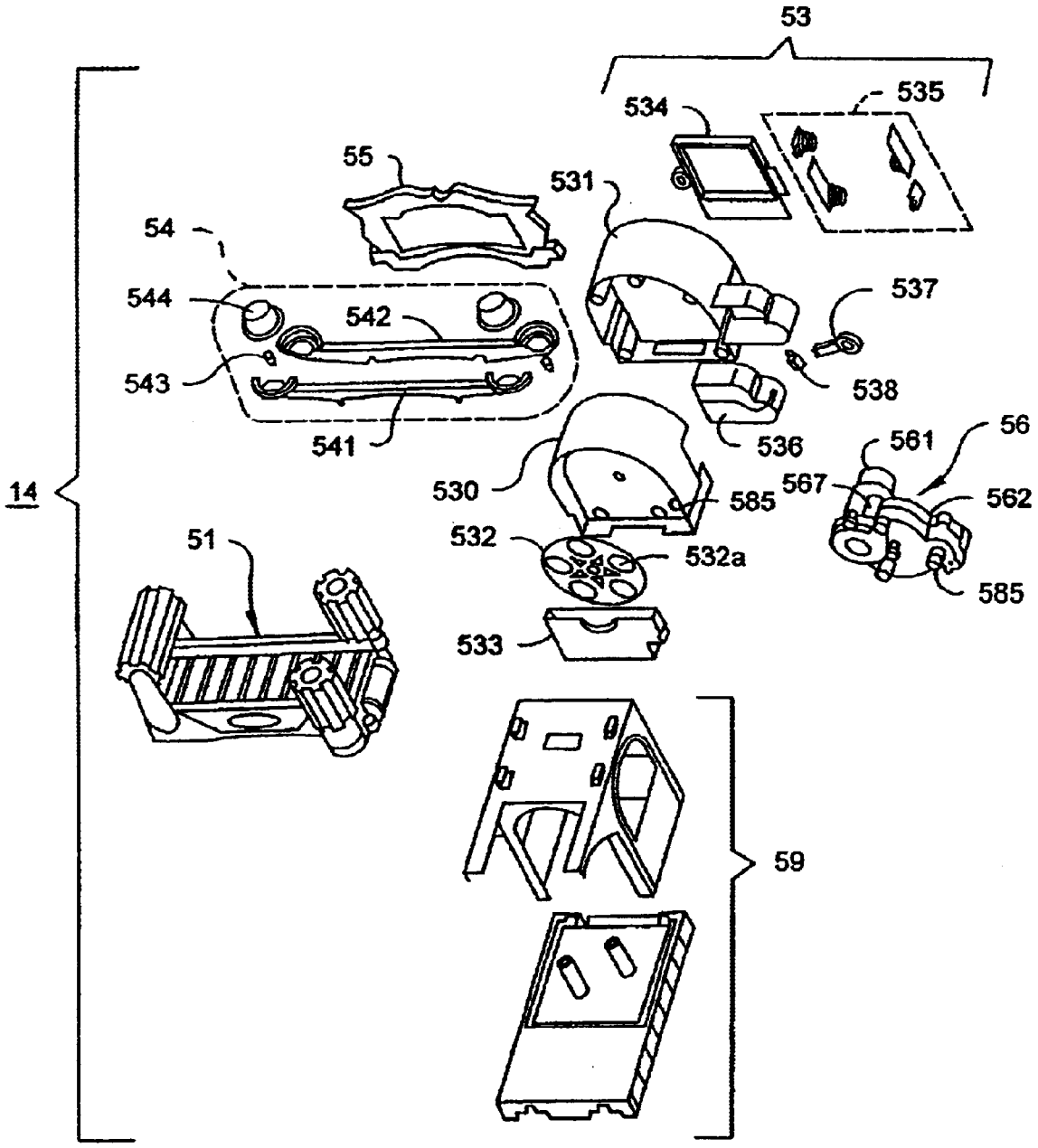
FIG. 7 is an exploded perspective view of the components of a wash conveyer/bubble unit of FIG. 4.

FIG. 7 indicates the components of the conveyer/bubble maker 14 with base 59. Referring to FIGS. 4 and 5, in addition to the base 59, the conveyer/bubble maker 14 includes a driven assembly 50 that includes a conveyer/vehicle washer indicated generally at 51, a bubble maker indicated at 53, a light bar indicated generally 54 and a sign 55. Referring to FIG. 7B, the conveyer/vehicle washer 51 includes a base member 511 and frame member 512 capturing between them a plurality of conveyer rollers 513 as well as drive roller components 514*a* and 514*b*, which receive at their respective ends drive gears 516 which are coupled together with shaft 517. The rollers 513 and drum components 514*a* and 514*b* are rotatably captured between the frame member 512 and base member 511 and rotatably support a continuous conveyer belt 520. A horizontal roller support 521 and horizontal roller pivot 522 supports horizontal wash roller 523. Vertical wash rollers 524 are supported on vertical rollers shafts 525 which are keyed into vertical roller mounts 526, which are crown gears mounted between base and frame members 511, 512 to engage roller gears 516. Roller gears 516 are driven by spur gears 528 and 529. Spur gear 529 has a shaft end 529*a* which is keyed to engage a drive socket 585 seen on the right side of FIG. 7 and in FIG. 7A.

The bubble maker 53 includes a main housing formed by a front housing shell 530 and a rear housing shell 531. A bubble maker disk 532 is mounted for rotation on the front of the front housing 530 and supported for partial immersion in a bubble tub 533. The housing 530/531 contains and receives a motor drive indicated generally at 56. The rear housing 531 also contains the battery supply which is retained by means of a door 534. Various connectors indicated generally 535 are provided in the rear housing 531 to couple the individual batteries of the battery power supply to the motor drive 56 and LED's 543. A switch housing cover 536 is also removably attached to one side of the rear housing 531 and pivotally supports a switch handle 537 and operating an on/off switch 538. The sign 55 is captured between the front and rear housings 530, 531 as is the light bar 54 (FIG. 5) formed by elongated shell halves 541, 542. The shell halves 541, 542 support at their distal ends LED's 543 and LED covers 544. The motor drive 56 includes a battery operated electric motor 561 and a motor drive housing 562 receiving the motor 561.

Figure 7A:
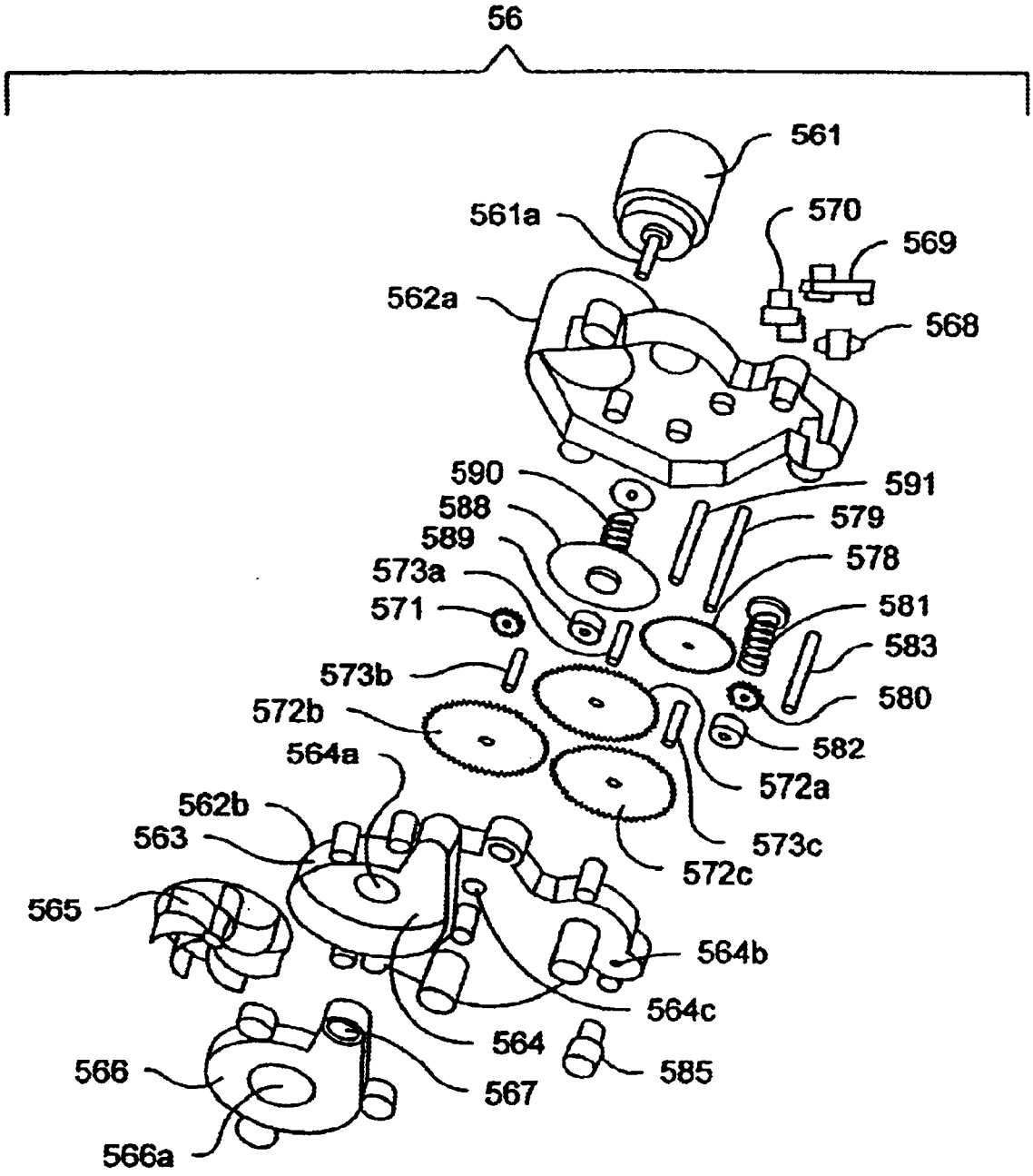
FIG. 7A is an exploded perspective view of the motor drive of FIG. 7.
Figure 7B:
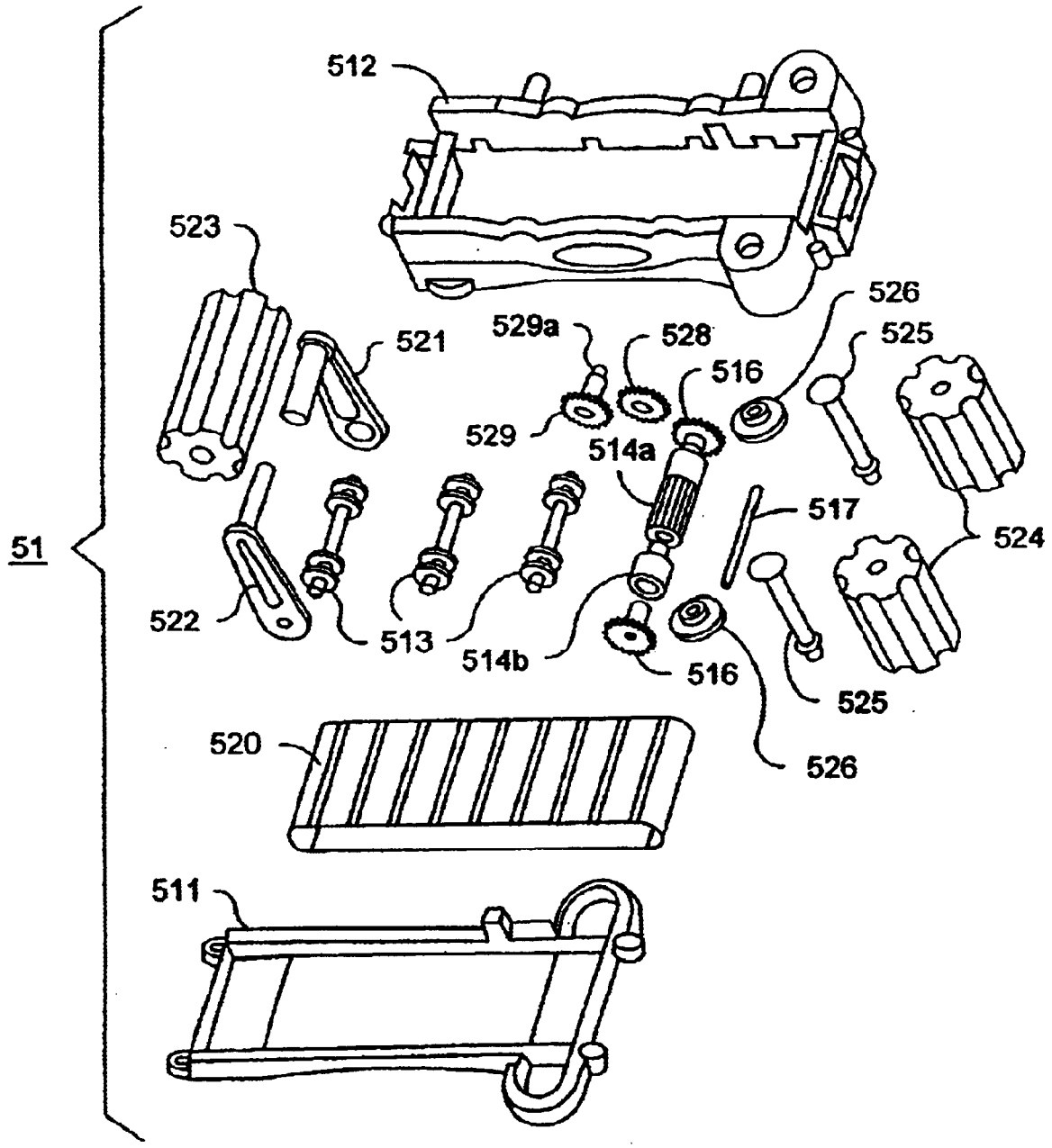
FIG. 7B is an exploded perspective view of the components of a conveyer/vehicle washer of FIG. 7.

FIG. 7A depicts the components of the motor drive 56. The front housing half 562*b* has on the left side a protruding wall 563 defining a fan chamber 564. A fan 565 is received in the chamber 564 and captured by fan cover 566. The fan cover 566 has an outlet 567 which is aligned with the openings 532*a* through the bubble disk 532 as the disk is rotated (FIG. 7). Attached to the rear housing 562*a* are a cam 568, a movable switch contact 569 and a stationary switch contact 570. Captured between the housing halves 562*a* and 562*b* are a series of gears and clutches, which include a motor pinion 571 fixed to the drive shaft 561*a* of the motor 561. Engaged with the motor pinion 571 are three compound gears 572*a*, 572*b* and 572*c* which are mounted for free rotation on jack shafts 573*a*, 573*b* and 573*c* and provide speed reduction. Two clutched output drives are provided, one to drive the bubble disk 532 to rotate and the other to drive the conveyer/vehicle washer 51 to rotate the conveyor belt 520 and the vertical and horizontal rollers 523, 524. The drive to the conveyer/vehicle washer 51 is provided by a compound gear 578 mounted for rotation on shaft 579. The smaller gear of compound gear 578 is engaged by the larger gear portion of third gear 572*c* in the direct drive train. The larger gear portion of compound gear 578 engages a geared clutch member 580, which is biased by spring 581 against a second clutch member 582, keyed to shaft 583. Also keyed to shaft 583 is a socket connection 585, which is exposed on the front housing shell 562*b* for engagement with the conveyer drive. Engaged with the larger gear portion of the second compound gear 572*b* is a geared clutch member 588 of a bubble wheeled clutch. Member 588 is biased against a second clutch member 589 by spring 590. Clutch member 589 is keyed to a shaft 591 extending through an opening 564*c* on the front housing shell 562*b* which drives bubble wheel 532 (FIG. 7).

Figure 9:
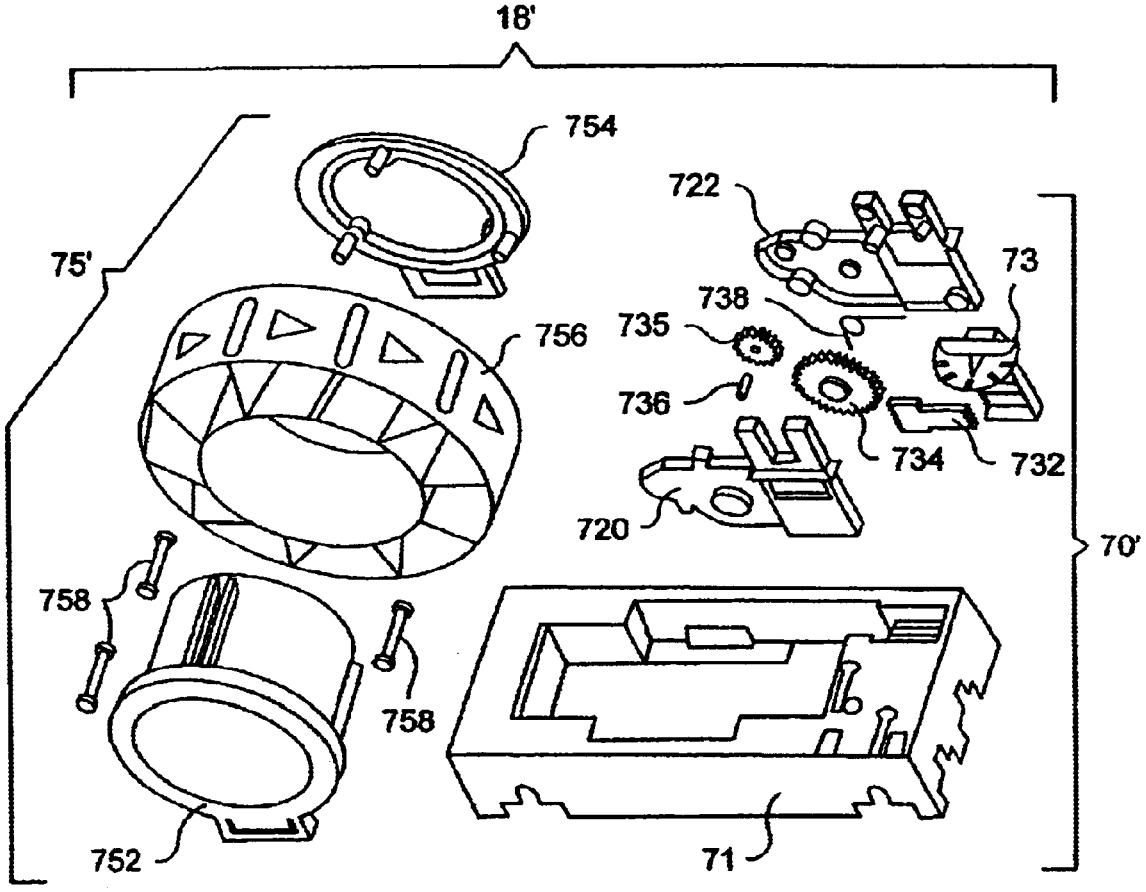
FIG. 9 is an exploded perspective view of the components of a fan dry unit of FIG. 4.
Figure 10:
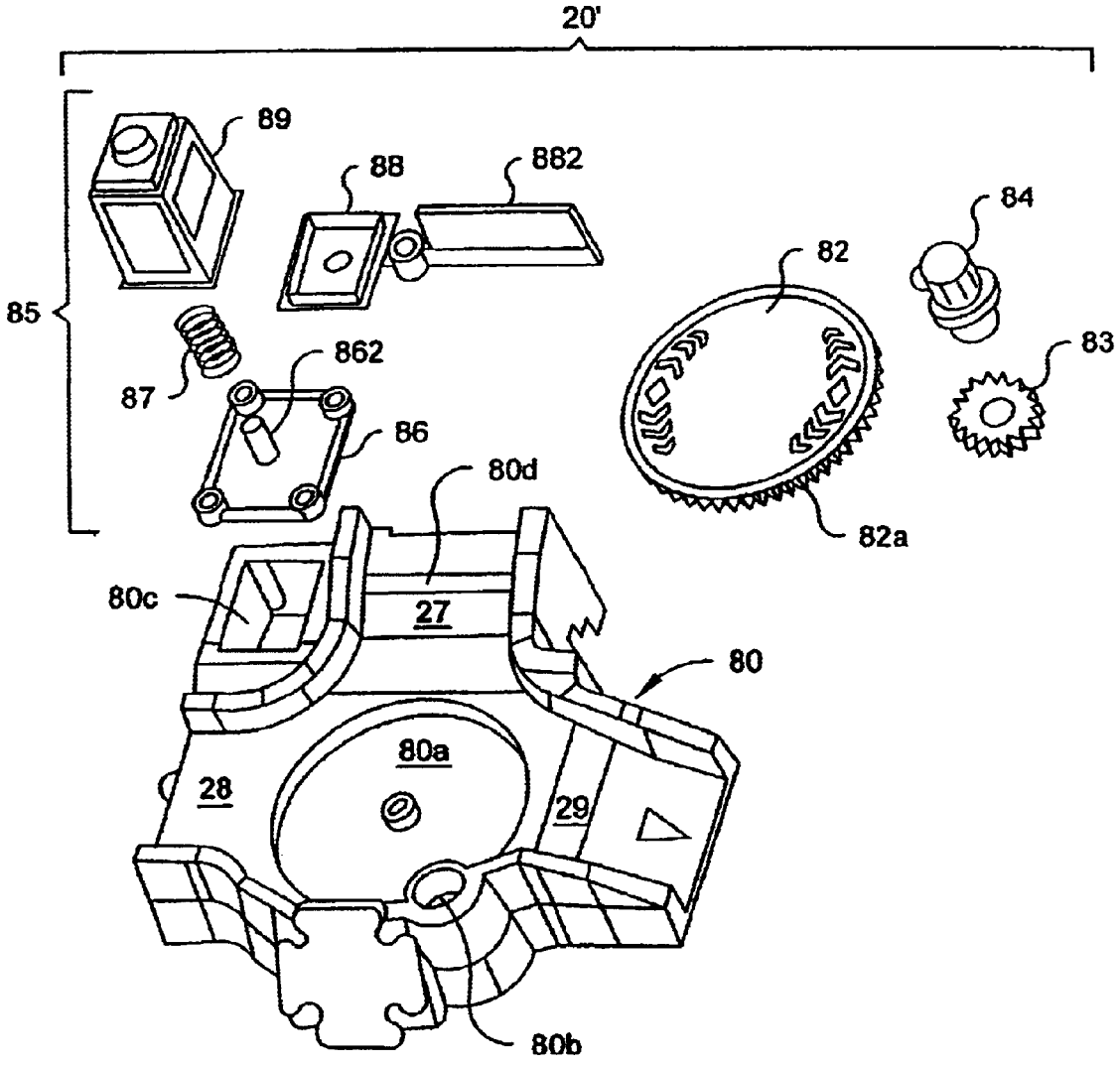
FIG. 10 is an exploded perspective view of the components of a turntable unit of FIG. 4.
Figure 11:
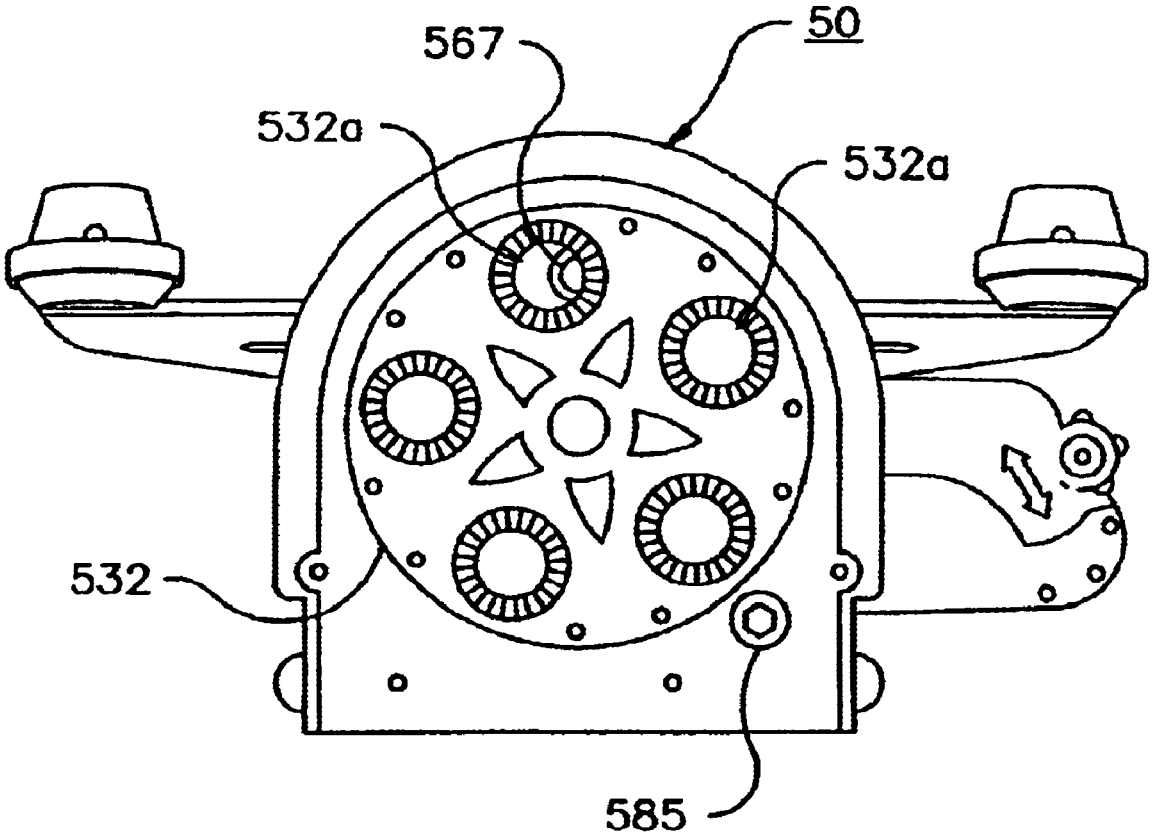
FIG. 11 is a side elevational view of the conveyer/bubble maker subassembly of FIG. 4 with washer rollers removed.

FIGS. 8–13 depict components of the car wash play set 10' in various states of disassembly. FIG. 11 shows the conveyor/bubble maker assembly 50 with the conveyer/vehicle washer 51 and bubble tank 533 removed. The bubble wheel 532 has been reinstalled on its drive shaft 591. The blower outlet opening 567 is shown in its alignment with one of the bubble making holes 532*a* of the wheel 532. Also shown in the lower right hand corner is the socket drive 585 which provides power to the conveyer/vehicle washer 51.

Figure 12:
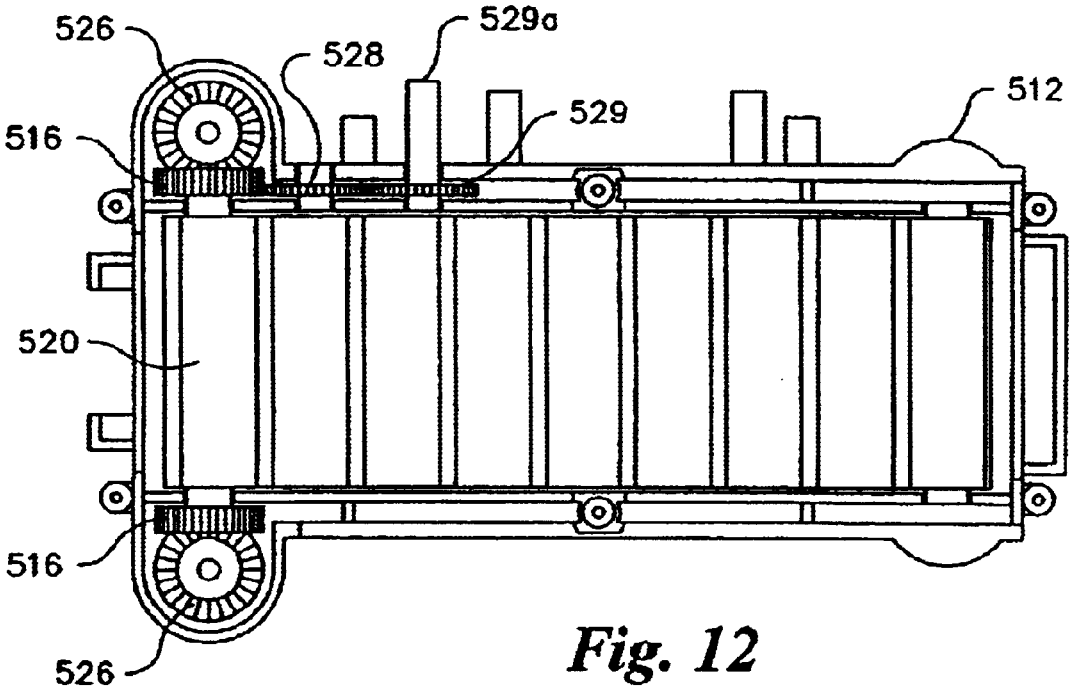
FIG. 12 is a bottom plan view of the conveyer of FIG. 11 with the bottom cover removed.
Figure 13:
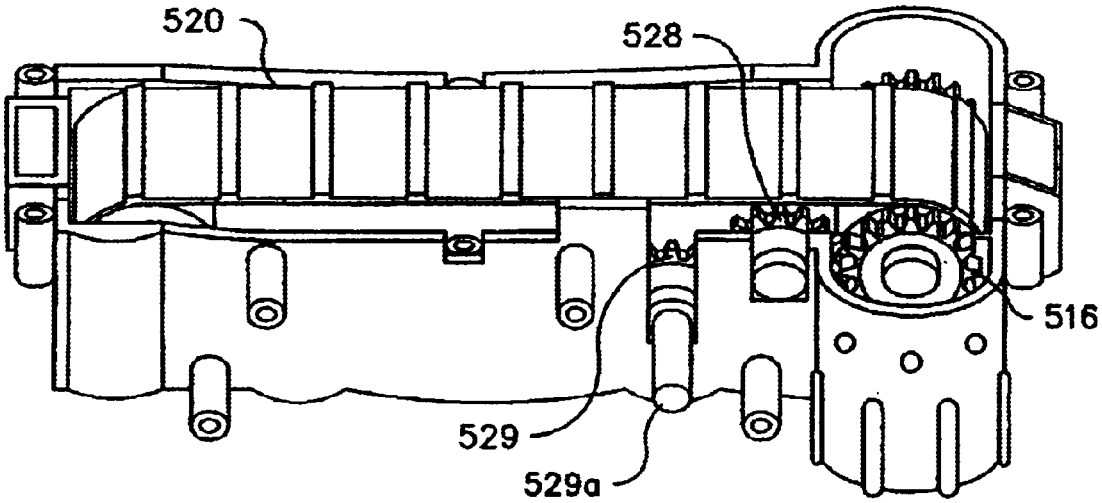
FIG. 13 is a rear side perspective view of the conveyer of FIG. 12 showing a portion of the gear drive.

FIG. 12 is a bottom plan view of the conveyer/vehicle washer 51, with the base member 511 removed to show the various gear members 516, 526, 528 and 529. The outer end 529*a* of gear 529 protrudes from the rear side of the frame 512 and is shaped to key into socket 585 on the front housing 530 (FIG. 11). FIG. 13 is a rear side perspective view showing the three gears 516, 528 and 529 engaged.

Figure 8:
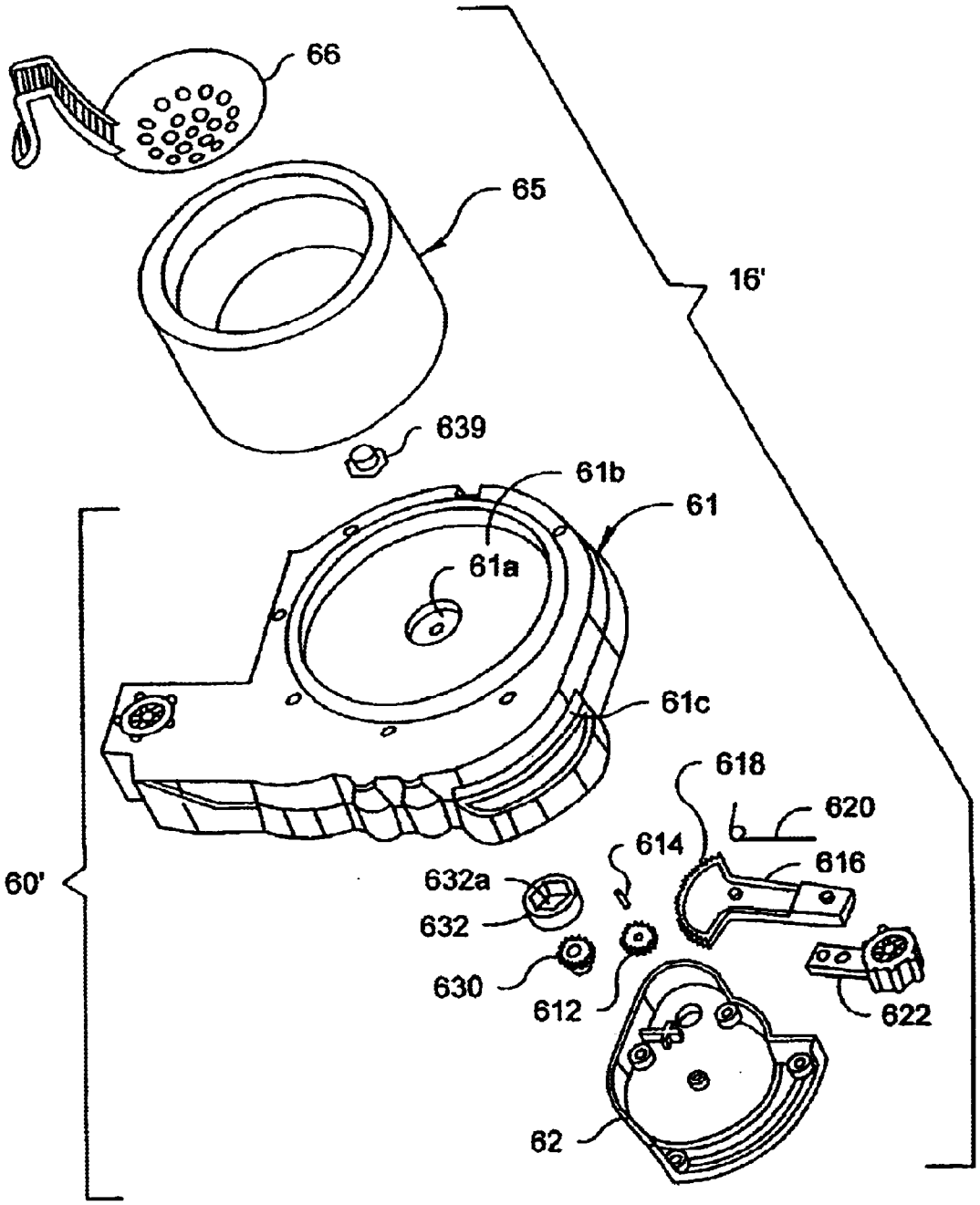
FIG. 8 is an exploded perspective view of the components of a rinse unit of FIG. 4.

FIG. 8 depicts the rinse tub 65, ladle 66 and the base 61 of the rinse unit 16' together with various drive components of the rinse unit 16'. The rinse unit 16' components include a lower cover 62 which is attached to the bottom side of base 61 and retains a floater gear 612 mounted to rotate on an axle 614, a bell crank 616 having a toothed face 618 meshing with the teeth of gear 612, a torsional spring 620 and a handle 622 secured to the outer end of bell crank 616 so as to protrude outwardly from the base 61 through a slot 61*c*. The bell crank 616 is mounted between the base 61 and lower cover 62 to be pivoted back and forth using the handle 622 to rotate the floater gear 612. The floater gear 612 is positioned for engagement with a rinse tub gear 630, which is located within the base 61 but coupled to a rinse tub mount 632 which is located in a central well 61*a* at the center of a larger well 61*b* on the upper surface of the base 61. The rinse tub mount 632 has its own multisided central recess 632*a* which is configured to receive and key with the same multiple sides on a rinse tub collar 639, which is nonrotatably attached to the bottom of rinse tub 65. Collar 639 keys the tub 65 to the tub mount 632 in recess 61*a*. The tub 65 is removably mounted to the base 61 in recess 61*b* and rotated clockwise by cyclic movement of handle 622. The ladle 66 is received in the bottom of tub 65. The ladle 66 cushions the impact of toy vehicles dropping into the tub 65 from ramp section 23 and can be used to lift vehicles from the tub 65 and deposit the lifted vehicles on ramp section 25 leading to the dryer station 18'. The modified rinse station 16' differs from the original in the location and movement of the rinse tub actuator.

FIG. 9 depicts the major components of the "dryer" station 18' including base unit 70' and fan assembly 75'. Base unit 70' includes a base housing 71 and a fan actuator including a drive housing 72 (FIG. 5) formed by front and rear housing halves 720, 722 that contains a rack handle 73 supporting a rack 732 for up and down movement within the housing 72. Rack 732 is engaged with and drives a compound acceleration gear 734 which in turn drives a floater gear 735 rotating on axle 736. The handle 73 is biased upwardly by torsion spring 738. An upper portion of the floater gear 735 is exposed in the upper corner of the housing 72 (FIG. 5). The fan assembly 75' includes a front stationary drum 752, a rear drum cover 754 and a "fan" member 756 mounted on a plurality of bearings 758 to rotate on the drum 752. The exposed upper edge of floater gear 735 is engaged with a gear integrally molded with the rear of the fan 756 for clockwise rotation of the fan 756 (when viewed from the front) as the handle 73 is pushed down and released. The dryer station 18' differs from the original dryer station 18 of FIGS. 1–3 in the configuration of "fan" 75 and the location and construction of the fan actuator.

FIG. 10 depicts the components of modified discharge station 20' including a base 80 with a central recessed opening 80*a* receiving a circular turntable member 82. The circumferential outer edge of the turntable 82 bears a plurality of gear teeth 82*a* which are engaged with a gear 83 supported for rotation inside the base 80 and coupled to a handle 84 in the form of a fire hydrant received in an opening 80*b* in the front right area of the top of the base 80. Rotation of the handle/fire hydrant 84 causes rotation of the gear 83 and turntable 82. An opening 80*c* in the upper left corner of the base 80 as seen in FIG. 10 receives a sub-base 86 of a gate/gate house actuator 85. Sub base 86 has a central post 862 supporting a compression coil spring 87 which in turn supports a gate/house base 88 for sliding movement up and down post 862. Base 88 in turn, supports a gate house 89. The gate portion 882 of base 88 is depressed into a slot 80*d* in the base 80 by pressing down on the house 89. The modified discharge station 20' differs from the original 20 in FIGS. 1–3 in that the handle of the original discharge station 20 turntable was located originally behind rather than in the front of exit ramp 29.

Operation of either version of the play set 10, 10' is substantially the same. The child can drive a toy vehicle up the ramp 21 onto the elevator base member 149 and manually place the toy vehicle between spirals 138*a*, 138*b* of the elevator assembly 40. The spirals are rotated by rotation of the crank 159. Rotation of the crank 159 clockwise rotates the left spiral 138*a* counterclockwise and the right spiral 138*b* clockwise when viewed from above. The spirals 138*a*, 138*b* drag the toy vehicle loaded into the bottom of the elevator 40 to the rear of the elevator 40 where the vehicle impacts the back 127*a* of the support 127 (FIG. 3). The spirals 138*a*, 138*b* continue to drag the vehicle into the elevator 40 pressing it against the back of the support 127 as the spirals 138*a*, 138*b* rotate beneath the vehicle and elevate the vehicle as they turn. Eventually, the vehicle passes through opening 127*b* in the top center rear of the spiral support 127. The vehicle is pushed by the spirals 138*a*, 138*b* onto the ramp section 22 which deposits the vehicle in the left end of the conveyer/vehicle washer 51 of the car wash/conveyor/bubble maker station 14 (FIG. 3).

The conveyer/vehicle washer 51 and bubble maker 53 are the only electrically powered components of either play set. The conveyer/vehicle washer 51 and bubble maker 53, are driven by the motor drive 56, the operation of which is controlled by on/off switch 537. The motor drive 56 provides a rotational output in the form of shaft 591 which rotates bubble maker disk 532 through a soapy water or other bubble forming solution in bubble tub 533 and past blower outlet 567 in front housing cover 566. The motor drive 56 further directly drives centrifugal fan 565 through front gear housing 562*b* causing the fan 565 to blow air through the outlet 567 aligned with the openings 532*a* and past which openings 532*a* in the bubble disk 532 must pass. The conveyer 520 is driven by the power takeoff through socket 585. LED 543 in the light bar 54 are caused to flash on and off by rotation of LED cam 568 on shaft 583. The conveyer 520 carries the toy vehicle beneath the overhead roller 523 and through the vertical rollers 524 to ramp section 23, which directs the toy vehicle by gravity into the rinse tub 65 (FIGS. 1–3).

The rinse tub 65 is also rotated clockwise (viewed from above) by movement and release of the bell crank handle 622. The floater gear 612 only engages the tub gear 630 while the handle 622 is being moved against spring 620. The rinse tub 65 may have a solid wall but could have a hollow wall construction which permits the addition of a liquid such as water within the wall, which can be made transparent, to give the impression that the vehicle within the tub is actually immersed in a rinse liquid. The vehicle is manually lifted from the tub 65 using the ladle 66 and is deposited on the ramp section 25, which leads to ramp section 26 passing through elevated base 59 and through the fan assembly of dryer station 18 or 18'. The "fan" of original fan unit 18 is caused to rotate by depressing and releasing a cylinder at the right front corner of the dryer station 18 in FIG. 1 while the fan member 756 in FIG. 9 is caused to rotate by depressing and releasing rack handle 73 at the right rear of dryer station 18'. Again, floater gear 735 only engages fan 756 while handle 73 is being depressed. The vehicle on ramp 26 is stopped at the forward end of the ramp by gate portion 882, which can be depressed by depressing the gate/house 89. The vehicle drops from the ramp section 26 across the central ramp 27 to the turntable 82. Turntable 82 can be rotated by handle 84 to direct the vehicle to ramp 28 leading to the elevator 12 or to the exit ramp 29.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy car wash play set comprising:

a toy vehicle car wash station, including a conveyer belt for transporting a toy vehicle from a first position to a second position, scrubbing rollers for simulating scrubbing rollers used in car washes for full-scale vehicles, and a bubble producing apparatus for simulating soap suds generated by car washes for full-scale vehicles.

2. The toy car wash of claim 1, wherein the bubble producing apparatus is motorized.

3. The toy car wash of claim 1, wherein the conveyer belt is motorized.

4. The toy car wash of claim 1, further comprising a base section, wherein the car wash station is elevated with respect to the base section by structural members connecting the base section to the car wash station.

5. The toy car wash of claim 4, further comprising an elevator for raising a toy vehicle from the base section to the car wash station.

6. The toy car wash of claim 5, wherein the elevator is manually operated.

7. The toy car wash of claim 1, further comprising a rinse station.

8. The toy car wash of claim 7, wherein the rinse station rotates under the action of a manual actuator.

9. The toy car wash of claim 1, further comprising a drying station.

10. The toy car wash of claim 9, wherein the drying station includes a fan.

11. The toy car wash of claim 10, wherein the fan is turned by a manual actuator.

12. The toy car wash of claim 4, wherein the base section includes a rotating table.

13. The toy car wash of claim 12, wherein the rotating table rotates under the action of a manual actuator.

14. The toy car wash of claim 2, wherein the motorized bubble producing apparatus further comprises a rotating wheel driven by an electric motor, wherein the rotating wheel has at least one aperture extending there through, and wherein the rotating wheel is partially immersed in a reservoir of bubble-producing solution, so that the aperture is covered by the bubble-producing solution as the rotating wheel rotates through the bubble-producing solution in the reservoir, the bubble producing apparatus further comprising a fan driven by the electric motor, wherein the fan blows air through the bubble-producing solution covered aperture, thus producing bubbles.

15. A toy car wash play set comprising:

a toy vehicle car wash station, including a conveyer belt, scrubbing rollers, and a bubble producing apparatus, wherein the conveyer belt and the bubble producing apparatus are motorized;

a base section, the car wash station being elevated with respect to the base section by structural members connecting the base section to the car wash station;

a manually operated elevator for raising a toy vehicle from the base section to the car wash station;

a rinse station including a manual actuator;

a drying station including a fan member having a manual actuator;

a rotating table in the base section having a manual actuator, wherein the motorized bubble producing apparatus further comprises a rotating wheel driven by an electric motor, wherein the rotating wheel has at least one aperture extending there through, and wherein the rotating wheel is partially immersed in a reservoir of bubble-producing solution, so that the aperture is covered by the bubble-producing solution as the rotating wheel rotates through the bubble-producing solution in the reservoir, the bubble producing apparatus further comprising a fan driven by the electric motor, wherein the fan blows air through the bubble-producing solution covered aperture, thus producing bubbles.

* * * * *